United States Patent [19]

Englund et al.

[11] 4,101,017

[45] Jul. 18, 1978

[54] MATRIX PRINT HEAD

[75] Inventors: Gösta Roland Englund, Stockholm; Karl Tommy Wincent, Upplands Väsby, both of Sweden

[73] Assignee: Svenska Dataregister Aktiebolag, Sweden

[21] Appl. No.: 697,299

[22] Filed: Jun. 17, 1976

[30] Foreign Application Priority Data

Jun. 30, 1975 [SE] Sweden ..... 7507469
Jan. 29, 1976 [SE] Sweden ..... 7600963

[51] Int. Cl.[2] ..... B41J 3/04
[52] U.S. Cl. ..... 400/124; 101/93.34
[58] Field of Search ..... 197/1 R; 101/93.04, 101/93.05, 93.15, 93.29, 93.33, 93.34, 93.28, 93.32; 335/270, 274, 276

[56] References Cited

U.S. PATENT DOCUMENTS

| | | | |
|---|---|---|---|
| 3,172,352 | 3/1965 | Helms | 101/93.34 |
| 3,285,166 | 11/1966 | Helms et al. | 101/93.34 |
| 3,834,506 | 9/1974 | Priebs | 197/1 R |
| 3,848,719 | 11/1974 | Milan | 197/1 R |
| 3,973,661 | 8/1976 | DeBoo et al. | 197/1 R |
| 3,982,622 | 9/1976 | Bellino et al. | 197/1 R |
| 3,994,381 | 11/1976 | Hebert | 197/1 R |

*Primary Examiner*—William Pieprz
*Attorney, Agent, or Firm*—Robert F. Rotella; Norman Friedman

[57] ABSTRACT

A matrix print head comprising a plurality of electromagnets each having an associated armature; a plurality of elongated print elements having ends adapted for printing markings on a data carrier; each of said print elements being associated with an armature; each of said print elements including a straight-line portion substantially perpendicular to said data carrier; said print element straight line portions being parallel to each other and being disposed in the same plane each of said print elements including an armature-engaging portion for resiliently maintaining its associated armature against its associated electromagnet, each of said print element armature-engaging portions permitting its associated armature to pivot about a first surface of its associated electromagnet whenever said electromagnet is energized, whereby the associated print element is thereby moved in a direction parallel to the straight-line portion thereof to thereby permit a marking on said data carrier to be printed.

5 Claims, 11 Drawing Figures

MATRIX PRINT HEAD

Figure 1:
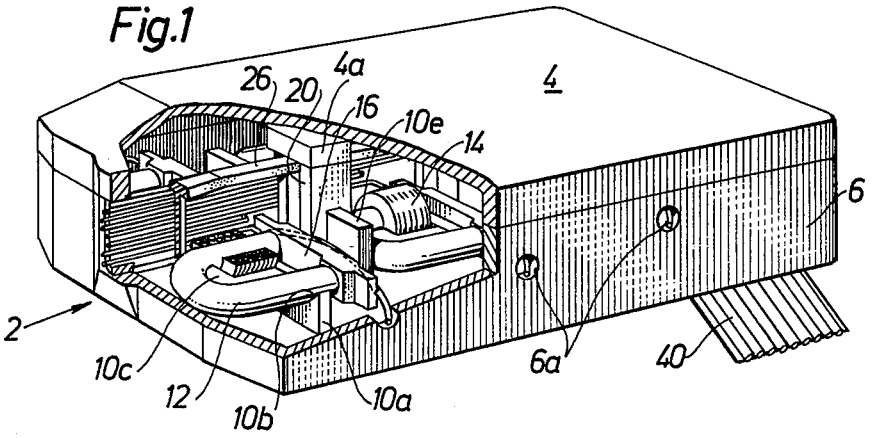

The present invention relates to a matrix print head.

During the latest decades the use of so called matrix printers for printing characters on data records has increased considerably. Such records may be receipts, verifications and count slips, for instance. When the print head is moved over the data carrier one or more electromagnets, usually seven electromagnets, are energized at predetermined points of time in order to move print needles co-operating with the electromagnets into contact with the data carrier so that the data carrier will be provided with a pattern constituting different characters.

A plurality of different matrix printers has been developed and manufactured but these printers have one or several disadvantages. Most of the printers are space requiring because the electromagnets are located in one single straight or curved row on the print head in the moving direction thereof. This means that the mass of the print head will increase and causes that the swift acceleration and retardation of the print head, when its moving direction is reversed, will be decreased. The print needles co-operating with the electromagnets of the print heads are often bent, due to the mounting of the electromagnets, and must, therefore, run in elongated tubes or in a plurality of bearings in order that they shall not be broken or bent further and thereby cease to function. The use of tubes has the effect that dust and dirt pierce into the tubes after a short time of use thereby increasing the friction and reducing the free movement of the needles in the tubes. The wear of the needles and/or of the tubes will also be increased. Moreover, the tubes and the bearings are often not easily exchangeable, and if bearings are used they consist of bearing blocks with through holes and are comperatively expensive to manufacture. Further, the known printers include a plurality of parts to mount the magnet armatures on the print head and to reset them to inactive positions at a distance from the magnets. This substantially increases the cost of manufacture, stock keeping and mounting and decreases the reliability. The electric conductors which are connected to the electromagnets, via more or less complicated coupling means and strain reliefs, are often coupled to a flat cable which is connected to the power supply source via different circuits. This further increases the cost of the print head, increases the time of assembling the print head and increases the mass thereof. A big problem with known printers also is that the print needles and their mounting in bearings at the end of the print head which is located near the print roll will be rapidly weared because the print head is moved in the direction of the print roll at the same time as the printing ends of the print needles contact the data carrier supported on the print roll, and that the character which is printed or just has been printed cannot be observed by the operator.

It is, therefore, an object with the present invention to remove the above mentioned disadvantages with the previously known matrix printers and to provide an inexpensive, light, simple and reliable matrix printer having a few parts and small outer dimensions and the components of which being easy to exchange.

Figure 2:
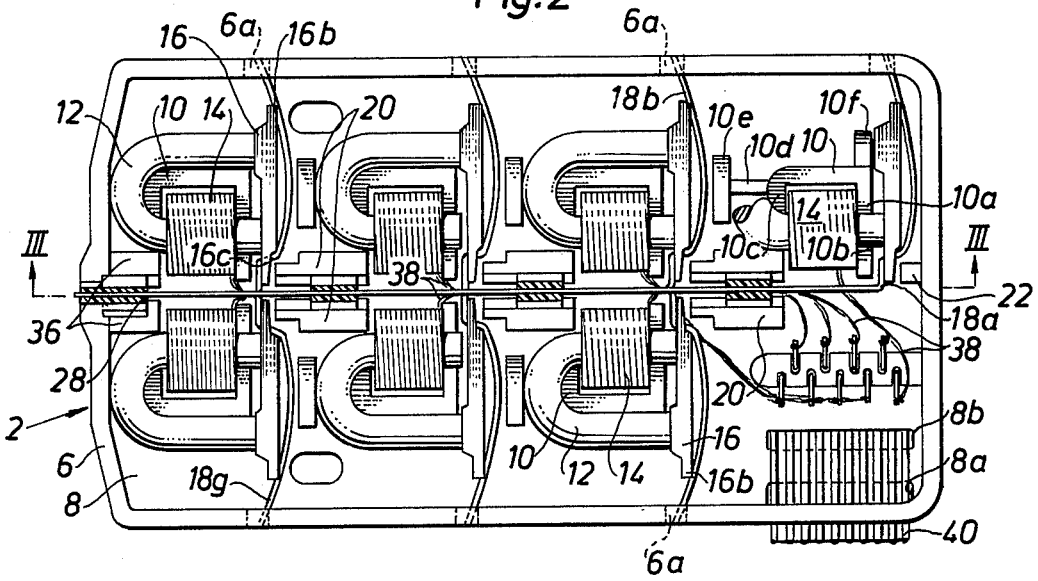
Figure 3:
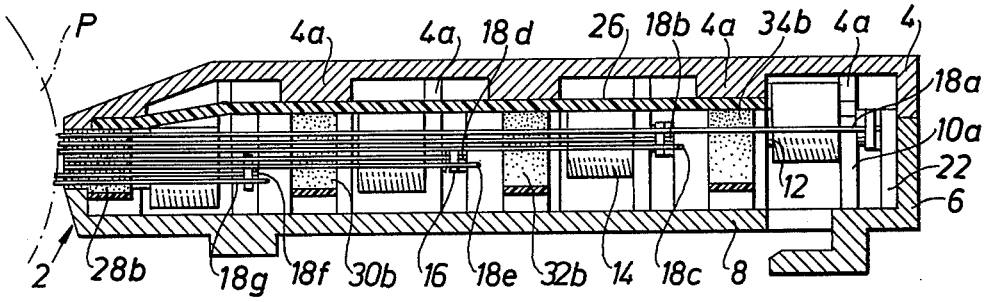
Figure 4:
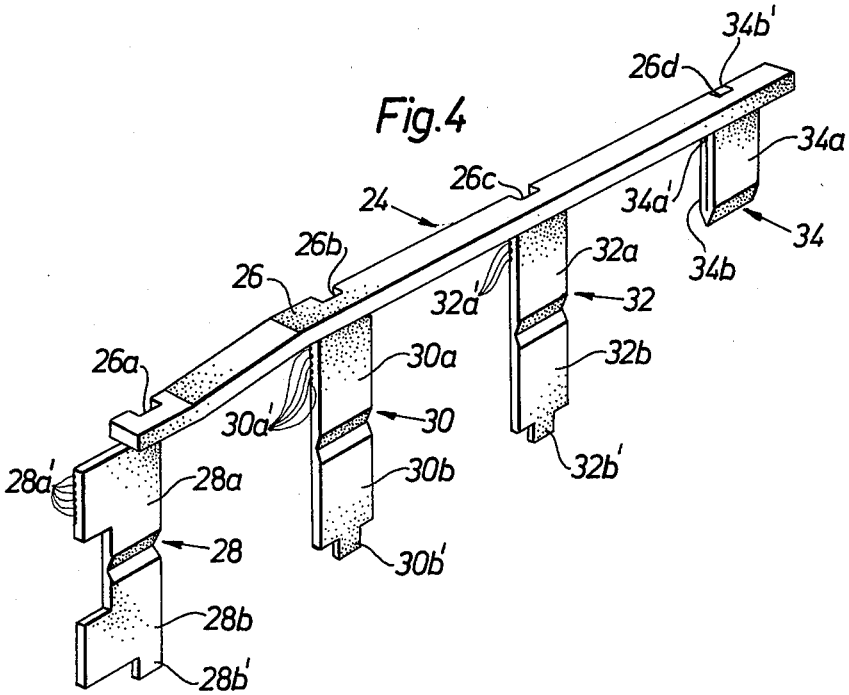
Figure 5:
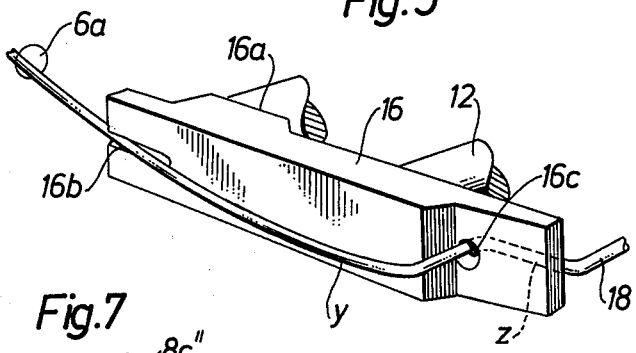

A preferred embodiment of the invention will now be described in connection with the enclosed drawings on which FIG. 1 is a perspective view, partly in section, of the matrix print head in accordance with the invention, FIG. 2 is a top view of the matrix print head in FIG. 1 with the upper half of the housing enclosing the print head removed, FIG. 3 is a sectional view taken along line III—III in FIG. 2, FIG. 4 is a perspective view of a holder releasably mounted in the print head, FIG. 5 is a perspective view of a magneto armature.

Figure 6:
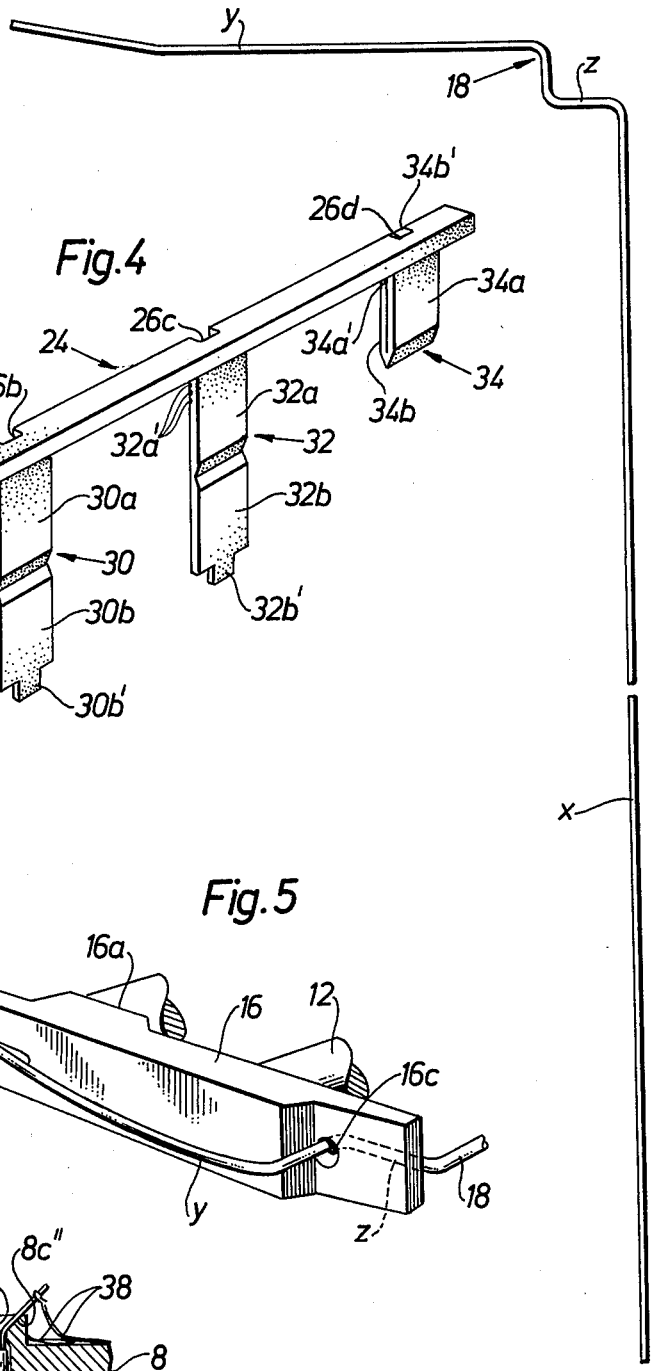
Figure 7:
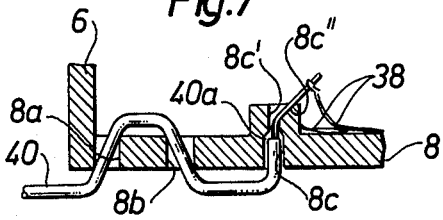
Figure 8:
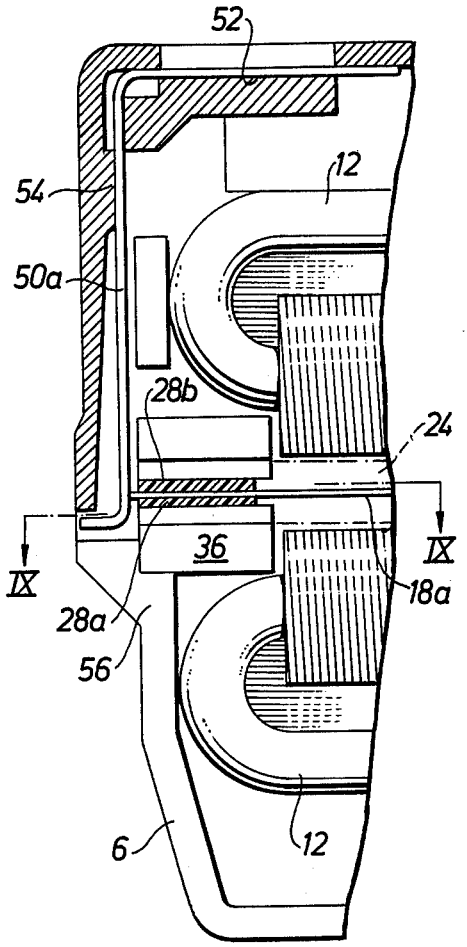
Figure 9:
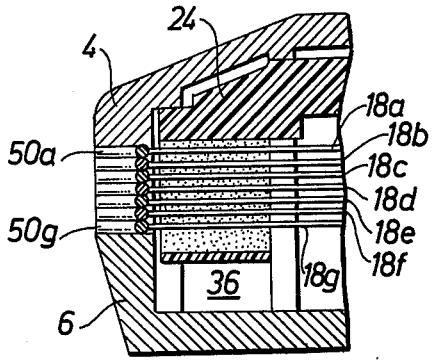
Figure 10:
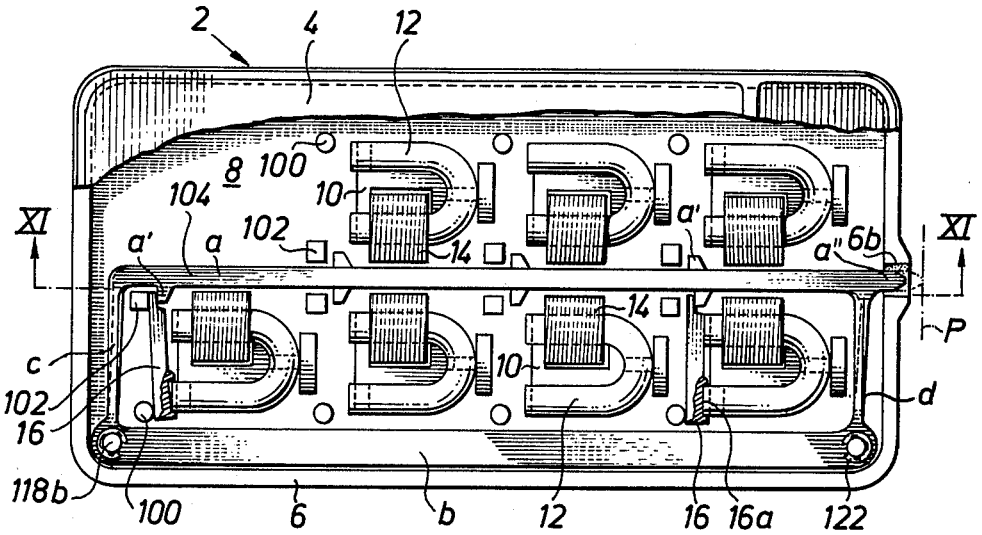
Figure 11:
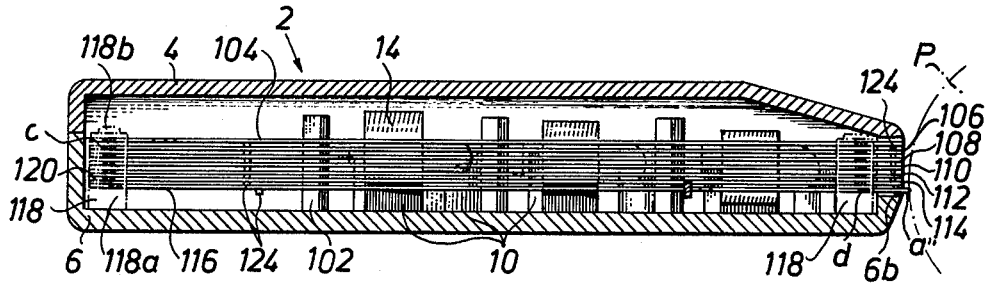

FIG. 6 is a plan view of a needle used as a printing element and a spring,

FIG. 7 is a view, partly in section, showing the mounting and connection of a flat cable to the electromagnets, FIG. 8 is a top view similar to FIG. 2 but showing a modified front part of the print head, FIG. 9 is a sectional view taken along line IX—IX in FIG. 8, FIG. 10 is a top view similar to FIGS. 2 and 8 but showing another embodiment of the invention, and FIG. 11 is a sectional view taken along line XI—XI in FIG. 10.

The matrix print head is generally designated 2 in the Figures and comprises two housing halves 4 and 6 which constitute the outer limits for the print head and which includes holding and bearing elements for the different components of the print head. The upper housing half 4 consists of a lid which preferably is made of plastics and which is fastened to the lower housing half 6 by means of glue and/or screws, so that these halves together define an essentially enclosed chamber in which no substantial amount of dust can penetrate. The lower housing half 6 is formed as a plastic box, and from the bottom 8 thereof extend T-shaped retaining elements 10 which are integral with the box. Each retaining element 10 consists of a T-shaped rib 10*a* having a first part with a top surface in which there is a semicircular recess 10*b* and a second part 10*f* constituting an extension of the first part (see FIGS. 1 and 2). The height of the second part 10*f* above the bottom of the box 6 is less than the rest of the rib 10*a* but the second part has the same height as the bottom surface of the recess 10*b*. The leg of the T-shaped rib 10*a* ends in a semicircular projection 10*c*. An extension 10*d* of the leg of the rib 10*a*, the height of the extension being less than the height of the rib 10*a* and having the same height as the part 10*f*, extends between the projection 10*c* and a support 10*e* the height of which exceeds the heights of the extension 10*d* and the rib 10*a*. In FIG. 2 only the parts of the retaining element 10 to the right in the Figure have reference symbols, and it should be understood that all the retaining elements have the same shape except for the two retaining elements to the left in the Figure the supports 10*e* of which consist of one of the side walls of the box 6, and except for the top surfaces of the seven ribs 10*a*, of the projections 10*c*, of the extensions 10*d* and of the parts 10*f*, and of the bottom surfaces of the recesses 10*b*, which all are located on different heights above the bottom of the box 6 due to reasons which will be described further below.

Each retaining element 10 retains a U-shaped magnet yoke 12. One leg of the yoke rests in the recess 10*b*, the underside of the other leg rests on the second part 10*f* of the rib 10*a* and the curved, intermediate part of the yoke rests on the extension 10*d* of the rib 10*a*. Moreover, the support 10*e*, the rib 10*a* and its projection 10*c*, the radius of which corresponds to the radius of the curved part of the yoke 12, prevent the yoke from moving in all directions in the horizontal plane because the curved part of the yoke is pressed between the support 10*e* and the projection 10*c* and because the top surface of the rib has a height exceeding the height of the top surface of the extension 10*d*, of the top surface of the part 10*f* and of the bottom surface of the recess 10*b*. The difference in said heights is greater than half the diameter of the yoke 12. A safe retaining effect of the yokes 12 in the vertical plane is obtained when the lid 4 is placed on the box 6 because downward extending projections 4*a* formed on the lid will abut and press on the top surfaces of the yokes above the recesses 10*b*, the extensions 10*d* and the parts 10*f*. The yokes 12 may be glued to the retaining elements 10 at certain locations, if desired, in order to secure the holding of the yokes so that they cannot be displaced from their exact positions.

A solenoid 14 is wound around one of the legs of each magnet yoke 12. The other leg of each yoke supports an iron armature 16. As is evident from FIG. 5, the armature 16 consists of a plate having a semi-circular recess 16*a* on one side and adjacent one end thereof, the diameter of the recess being somewhat longer than the cross section diameter of the yoke leg. In said end of the armature 16 there is a slit-shaped recess or groove 16*b* extending in the longitudinal direction of the armature, and at the other end of the armature there is a hole 16*c*.

The armatures 16 are retained in desired locations only by means of steel wires 18*a–g* functioning as springs and having different lengths. Each wire 18*a–g* is originally bent in a manner shown in FIG. 6, and all the wires are identical except for the legs *x* which have different lengths. The long leg *x* of the wire 18*a* is the longest leg becuase it is engaged by the electromagnet which is situated at the longest distance from the front end of the print head. The wires 18*b* and 18*c* are identical but shorter than the wire 18*a*, the wires 18*d* and 18*e* are identical but shorter than the wires 18*b* and 18*c*. Because the other portions of the wires are identical all the wires 18 can be bent in exactly the same manner in the same tool and, thereafter, the long legs *x* can be cut to desired lengths.

One end of each armature 16, i.e. the end having the recess 16*a*, is pressed against one leg of the pertaining yoke 12 by the wire 18 which extends through the hole 16*c* and is held in the recess 16*b*. The end of the short leg *y* of the wire 18 will namely be bent to the left in FIG. 2, when the armature 16 and the wire are mounted into the print head and said end is introduced through a hole 6*a* in the box 6, so that the leg is deformed to the condition shown in the Figure. Because the outermost end of the armature 16 which is provided with the recess 16*b* extends a short distance out from the bearing point between the yoke 12 and the armature 16 (at the recess 16*a*) the armature constitutes a two-armed lever. Said last mentioned end will therefor be pressed to the left in FIG. 2 by the spring force in the short leg *y* of the wire 18, and the other end of the armature, i.e. the end which has the hold 16*c*, will take a position at a distance from the yoke 12 and in this position will abut against a support formed integrally with the box 6. The six supports to the left in FIG. 2 are designated 20 while the single support for the armature which contacts the yoke by means of the wire 18*a* is designated 22.

When the electromagnets are not energized the armatures 16 take the position as shown for the two armatures which are held by the wires 18*d* and 18*e*, i.e. the armatures are pressed against the supports 20, 22 by means of the spring force in the short legs *y* of the wires, and the printing ends of the long legs *x* of the wires take a position at a distance from a data carrier (not shown) on a print roll P. However, when the electromagnets are energized the armatures are moved to the position shown for the five armatures which are held by the wires 18*a*, 18*b*, 18*c*, 18*f* and 18*g*, i.e. the legs on the yokes 12 around which the solenoids 14 are wound attract the armatures whereby—due to the fact that a short portion Z of each wire makes contact with the left side of the pertaining armature between the hole 16*c* in the armature and the end of the armature which is near the hole—the wires are displaced to the left in FIGS. 2 and 3 and print dots which form characters on the data carrier. At the same time as the enegization of the electromagnets ceases the armatures 16 are restored to their disengaged positions into contact with the supports 20, 22 by means of the spring force generated by the short legs *y* of the wires 18.

An integrally formed plastic holder 24 is arranged for guiding and supporting the wires 18. The holder 24, which is shown best in FIG. 4, comprises a rib 26 and four bearing members 28, 30, 32 and 34. Each member 28, 30, 32 and 34 comprises two bearing halves 28*a* and *b*, 30*a* and *b*, etc., one of which 28*a*, 30*a*, etc. extends downwards from the rib 26 and the other of which 28*b*, 30*b*, etc. is foldably connected to the first one. When mounting the print wires 18*a–g* the holder is laid on a table, for instance, so that the bearing halves 28*a*, 30*a* etc. make contact therewith and the bearing halves 28*b*, 30*b*, etc. are directed away from the other bearing halves. Thereupon, the wires 18*a–g* are inserted into grooves in the bearing halves 28*a*, 30*a*, etc. In the bearing half 28*a* there are seven grooves 28*a'* because all seven wires 18*a–g* are to be supported in the member 28 which is far to the left in the Figures. In the other members 30, 32 and 34 there are thus five, three and one groove 30*a'*, 32*a'* and 34*a'*, respectively. The shortest wire 18*f* or 18*g* is thus supported in one bearing member 28, and the longer the wires are the more supporting points are needed in order that the wires shall not be bent when they are moved towards the print roll P. Thus, the wire 18*a* has four supporting points. After the wires 18*a–g* have been inserted in the grooves 28*a'*, 30*a'*, etc.—the depth of each one somewhat exceeding the diameter of a wire—the bearing halves 28*b*, 30*b*, etc. are folded to make contact with the bearing halves 28*a*, 30*a*, etc. and are locked to these halves by means of tabs 28*b'*, 30*b'*, etc. which engage notches 26*a*, 26*b*, etc. in the rib 26. Thereafter, the holder 24 is inserted between the supports 20 and two supports 36, which together constitute four pairs of supports, until the underside of the rib 26 makes contact with the top surfaces of the supports. The distance between the supports 20, 36 in each pair of supports is so choosen that the bearing members 28, 30, etc. are retained between the suppports with press fit. The holder 24 is also prevented from moving vertically upwards because the projections 4*a* on the lid abut the top surface of the rib 26 and press it downwards after the lid has been mounted on the box 6. After the holder 24 and the wires 18 have been inserted between the pairs of supports the short legs *y* of the wires are oriented in a direction out from the central longitudinal axis of the print head, and the armatures 16—which previously were mounted on these legs via the holes 16*c*—are mounted on one leg of the yokes 12. Thereafter, the ends of the short legs of the wires are bent and inserted onto the holes 6*a* in the box 6.

As best can be seen in FIGS. 2, 3 and 4 the bearing member 28 is longer than the other bearing members, seen in the longitudinal direction of the rib 26, and extends all the way up to the tip of the print head to secure effective support for the front ends of the wires 18. If desired, the bearing member 28 and possibly also the other three bearing members 30, 32 and 34 may be provided with a hard plate with holes instead of having the grooves 28*a'*, 30*a'*, etc. This plate may be moulded in or in any other manner be secured to the holder 24 in order to improve the bearing effect and decrease the wear of the bearing elements.

In order that the yokes 12 and the armatures shall be on the same level in a vertical plane as the pertaining print wires 18 which are located on different levels, the parts 10*a–f* of the retaining elements 10 have different heights above the bottom 8 of the box 6. Thus, the parts 10*a–f* for the electromagnet to the far right in FIG. 2 are highest and the parts 10*a–f* which support the adjacent magnet, which engages the wire 18*b*, have a height above the bottom 8 which is less than the height for the parts 10*a–f* for the magnet to the far right. The difference in heights between the last mentioned parts is equal to the distance between the wires 18*a* and 18*b*. The heights of the other magnets above the bottom 8 decrease successively to the left in the same manner as has been described above and which is evident from FIG. 3.

The power supply to the solenoids 14 is accomplished by a conventional power supply unit (not shown), which is connected to circuits (not shown), which emit pulses to the solenoids to energize them at different points of time when the print head is moved along the print roll P. The wires, conducting current from said circuits to the connecting wires 38 of the solenoids 14, are assembled in a flat cable 40, best shown in FIG. 7. The isolation of said cable has been removed at one end thereof so that a supporting edge 40*a* is formed by the isolation. Seen from the outside of the box 6 the flat cable 40 has been drawn through a hole 8*a* in the bottom 8 of the box 6 and thereafter drawn back through an adjacent hole 8*b* in the bottom 8. Then the cable has been drawn back towards the box again to a recess 8*c* communicating with holes 8*c'* the number of which is equal to the number of separate wires in the flat cable and the diameters of which are somewhat longer than those of the separate wires. The edge 40*a* of the flat cable 40 supports against the walls between the holes 8*c'* in the recess 8*c*. The ends of the separate wires in the flat cable 40 are alternatingly bent to the right and to the left in FIG. 7 so that they make contact with oblique steps 8*c''* in the holes 8*c'*. Due to the recess 8*c*, the steps 8*c''*, the holes 8*a*, 8*b* and 8*c'*, the edge 40*a* and the separate wires bent in different directions it is assured that the flat cable 40 is retained in the box without need for special strain reliefs and clamp members. The free ends of the separate wires in the flat cable form so called soldering towers to which the connecting wires 38 of the solenoids are soldered without any need for special connecting means.

In FIGS. 8 and 9 there is shown a modified embodiment of the front end of the print head. The ends of the wires 18*a–g* which are nearest the print roll P terminate at a longer distance from the roll P than do the ends of the wires according to FIGS. 1–3 and make contact with transfer elements in the form of spring wires 50*a–g*, each one of which being bent in its ends to form a relatively long end portion which is fixed to the box 6 and a relatively short end portion the edge surface of which being directed towards the print roll P and forming a printing surface. In the vertical plane the wires 50*a–g* contact each other along their whole lengths and each one has a thickness which is so choosen that the front end of each wire 18*a–g* will lie in the same horizontal plane as the pertaining wire 50*a–g*, which means that the thickness of each wire 50*a–g* is somewhat greater than the thickness of each wire 18*a–g* because the wires 18*a–g* are arranged at a distance from each other in the holder 24, the front end of which being somewhat modified in this embodiment.

The relatively long end portions of the wires 50*a–g* are inserted in a recess 52 in the box 6 and are fixed thereto in a suitable manner. A supporting surface 54 on the front portion of the box 6 (said portion differs somewhat from the corresponding portion in FIG. 1–3 in order that the wires 50*a–g* shall have sufficient space to be mounted) serves to press the wires 50*a–g* against the end surfaces of the wires 18*a–g* so that the wires 18*a–g*, which can be said to constitute push rods, are resiliently displaced backwards in the print head 2 and, therefore, force the armatures 16 in a direction from their yokes 12. The spring force in the wires 50*a–g* can be of the same magnitude as the spring force in the short legs *y* of the wires 18*a–g*. Thus, the last mentioned legs are not needed as springs but needed to retain the armatures 16 on the yokes 12. However, there may be a small spring force but in such a case a relatively great spring force must still be generated by the legs *y*.

The wires 50*a–g* have circular cross sections and the friction between them is therefore small when they are bent because there is only line contact between the adjacent wires. The wires 50*a–g* support each other in their rest positions and during the bending as well.

In order that the character which is printed on the data carrier and the character or characters which have been printed immediately before said printing can be inspected by an operator, the front portion 56 of the wall of the print head 2 has been removed because this wall does not form any bearing for the print wires. Also, parts of the walls of the support 36 and the box 6 in front of the wires 50*a–g* can be removed and the front portions of the lid 4 can be made transparent to further facilitate the inspection of the characters.

With the embodiment shown in FIGS. 8 and 9 at least two difficult problems in connection with matrix printers are solved. One of the problems with the known printers is that the bearings for the front ends of the print wires are worn quickly because the print head is moved relatively to the immovable data carrier on the print roll during the printing operation while the printing surfaces of the print wires engage the data carrier, whereby the print wires with a strong force press against the side of the bearing which is turned in the opposite direction to the moving direction of the print head. Even if the bearings are manufactured from a very hard material, the material will quickly be worn out in one end of the bearing due to said pressing action and also due to the fact that paper fragment removed by the end surfaces of the print wires pierces into the bearings and increases the friction between the bearing surfaces and the print wires. As is evident from the above description of the embodiment in FIGS. 8 and 9 the front bearing member 28 is not subjected to any compressive or tensile strains because special transfer elements 50 and not the wires 18*a–g* engage the data carrier and because the front surfaces of the wires 18*a–g* with a small friction force make contact with and engage the transfer elements. The other problem in known matrix printers is that the operator cannot inspect the character which is printed on the character or characters which just have been printed because the bearing in the front end of the print head prevents such inspection. With the embodiment described above and shown in FIGS. 8 and 9 such inspection will be possible because no bearing members are arranged in the front end of the print head.

In FIGS. 10 and 11 there is shown another embodiment of the invention. In a way similar to that shown in FIGS. 2 and 5 the armature 16 is retained in a correct position by means of the circular recess 16*a* which is supported by the end of one leg of the yoke 12 and is prevented from being removed therefrom by a cylinder support 100 formed in the bottom 8 of the box, by a parallelepipedic support 102 and by a spring printing element the design of which will be described further below.

Each of the spring printing elements, which are designated 104–116, has the form of a parallelogram with essentially right angles and the two side portions *a* and *b* of which, which are perpendicular to the print roll P, are wider than the side portions *c* and *d* which are parallel to the print roll. However, the side portions *a–d* are wider than their thickness.

Each one of two cylinder elements 118, which are fixed to the bottom 8 of the box, has a lower part 118*a* with a relatively long diameter and an upper part 118*b* integral with the lower part and centrally disposed with respect to the top surface of said lower part. The diameter of the upper part is less than that of the lower part. Each one of the print elements 104–116 has holes in two of its corners, the diameter of each hole somewhat exceeds the diameter of the upper part 118*b* of a cylinder element but is less than the diameter of the lower part 118*a* of the said cylinder element. Therefore, the print elements 104–116 can be mounted on the upper parts of the cylinder elements 118. The element 116 is first mounted so that it will make contact with the top surfaces of the lower parts of the cylinder elements. Thereafter, a spacer 120, having a predetermined thickness, is mounted on the upper part of each cylinder element 118, and print elements and spacers are then alternatingly mounted until the uppermost print element 118 has been mounted. Thereafter, the print elements 104–116 is locked to the cylinder elements 118 by means of a lock washer 122 or similar means.

In order to keep the print elements 104–116 at a distance from each other, also along the side portions *a, c* and *d* which are not spaced from each other by means of the spacers 120, each print element on the underside of its elongated side portion *a*, located between the two rows of electromagnets which all are mounted on different heights above the bottom 8, is provided with one or more projections in the form of warts, the thickness of each corresponds to that of a spacer 120. The reason why a certain distance is desired between print elements is that they shall not stick to each other (whereby the friction increases between the elements) when they move relatively to each other in a way described here below.

The said portion *a* of each print element 104–116 is also provided with a side projection *a'* which extends to a pertaining armature 16 of an electromagnet and which, in the unexcited condition of the electromagnet, presses the armature against the pertaining support 102. This condition is shown for the electromagnet down to the left in FIG. 10.

In the end which is nearest the print roll P each print element 104–116 is provided with an abutting portion *a''* being an extension of the side portion *a'*. The abutting portion *a''* is pointed in its free end and defines a printing surface which projects out through an opening 6*b* in the box 6 and hits a data carrier on the print roll P when the pertaining electromagnet is energized.

When any one of the electromagnets is energized its armature 16 is rotated around the point of rotation on one leg of the yoke 12 so that the armature will make contact with the other leg of the yoke which has the solenoid 14. This condition is shown for the electromagnet down to the right in FIG. 10. The armature 16 will therefore move the side portion *a* of the pertaining print element 104–116 to the right in the Figures via its side projection *a'* so that the abutting portion *a''* hits the print roll P. This condition is shown for the side portion *a* on the print element 116 (FIGS. 10 and 11). This movement of the side portion *a* to the right is counteracted by the spring force in the side portions *c* and *d*. This force tries to press the armature 16 to the left in the Figures to a position where it makes contact with the pertaining support 102 with a light pressure. The spring force accomplished by the side portions *c* and *d* is so weak that the armature 16 very swiftly can move the side portion *a* without the need for a great amount of energy needed to energize the solenoid 14. However, the force is so great that as soon as the solenoid has been unexcited the portion *a* shall return to the normal position, i.e., to the position shown for the portion *a* on the print element 104 in FIG. 10. The spring action of the print elements 104–116 is accomplished by bending the portions *c* and *d*, the cross section of which near the side portions *b* are less than their cross section near the side portions *a*, in order that the bending shall take place as far as possible from the side portions *a*.

Each print element 104–116 has been manufactured in one piece from a metal having such properties that repeated bending of the side portions *c* and *d* will be possible without any risk for the print elements to be broken or to loose their flexible properties. The abutting portions *a''* may be hardened, if desired, in order that the front surfaces shall not be worn when hitting the data carrier on the print roll P.

It is evident from the above description that the print head shown in FIGS. 10 and 11 is very reliable and has a simple design and includes a few different elements to accomplish the desired functions. The embodiment shown in FIGS. 10 and 11 can be modified if so desired. For instance, each print element may have only one elongated side portion *a* and flexible side portions *c, d* connected to the side portion *a* the free ends of said side portions *c, d* being fixed in the print head in a suitable manner. Thus, the side portion *b* may be omitted. The side portion *c* may then be directed upwards in FIG. 10 and being connected to the upper left corner of the box 6 in a suitable manner, if so desired. The side portion *c* may also be omitted if so desired. In such a case, however, a suitable means may be connected to the print head at the end thereof remote from the print roll, said means guiding the side portion *a* in its longitudinal direction.

Some embodiments of the invention have been described above but it should be understood that the invention is not limited to these embodiment and that modifications thereof or other embodiments are possible within the scope of the invention as defined in the following claims.

We claim:

1. A matrix print head comprising:

a plurality of electromagnets each having an associated armature;

each of said electromagnets including a pair of poles;

a plurality of elongated print elements having ends adapted for printing markings on a data carrier;

each of said print elements being associated with an armature;

said armature comprising a bar including first and second portions;

said armature being pivotable about said first pole at said first portion of said bar;

each of said print elements including an armature-engaging portion for resiliently maintaining its associated armature against its associated electromagnet;

said print element armature-engaging portion being in contact with each end of said bar;

one end of said bar being provided with a groove and the other end of said bar is provided with a hole;

said groove accommodating a first part of said armature-engaging portion and said hole accommodating a second part of said portion;

each of said print elements including a straight-line portion substantially perpendicular to said data carrier;

said print element straight line portions being parallel to each other and being disposed in the same plane;

each of said print element armature-engaging portions permitting its associated armature to pivot about a first one of said poles whenever said electromagnet is energized; whereby the associated print element is thereby moved in a direction parallel to the straight-line portion thereof to thereby permit a marking on said data carrier to be printed.

2. A matrix print head as set forth in claim 1, wherein:

said print head includes a housing;

said print element armature-engaging portion having its end terminating at a wall of said housing;

said end being relatively fixed with respect to sai wall.

3. A matrix print head comprising:

an electromagnet including an armature movable into first and second positions in accordance with the energization of said electromagnet;

a printing element coupled to said armature and movable therewith;

a first end of said printing element being adapted to print markings on a data carrier and a second end of said printing element maintaining said armature in pivotably movable relationship with said electromagnet;

said printing element second end maintaining said armature by resiliently urging a first portion of said armature constantly against a first portion of said electromagnet;

said printing element comprising an elongated portion terminating in said first end;

said second end being disposed at an angle relative to said elongated portion and forming a flexible spring leg cooperating with said armature;

said first portion of said electromagnet comprising a first pole;

said first portion of said armature being urged by said spring leg against said first pole; and said second portion of said armature being in selective contact with a second pole of said electromagnet in accordance with the state of energization of said electromagnet; whereby energization of said electromagnet causes said armature to pivot about said second pole and resultant movement of said printing element along its elongated portion.

4. A matrix print head as set forth in claim 3, wherein:

said armature first portion comprises recess means at least partially surrounding said first pole; and said armature is provided with a groove into which said spring leg is disposed for urging said armature first portion against said first pole.

5. A matrix print head as set forth in claim 4, wherein:

said spring leg extends through a hole provided in said armature second portion.

* * * * *